US005102725A

United States Patent [19]

Knox et al.

[11] Patent Number: 5,102,725

[45] Date of Patent: Apr. 7, 1992

[54] DUAL LAYER COMPOSITE FABRIC

[75] Inventors: Martha Knox, Slater, S.C.; Richard G. Adams, Lavallette, N.J.; Duncan Black, Greenville, S.C.

[73] Assignee: JPS Converter and Industrial Fabric Corp., Slater, S.C.

[21] Appl. No.: 678,223

[22] Filed: Apr. 1, 1991

[51] Int. Cl.[5] ..... B32B 7/00

[52] U.S. Cl. ..... 428/245; 428/225; 428/226; 428/251; 428/252; 428/408; 428/902

[58] Field of Search ..... 428/225, 226, 116, 245, 428/251, 252, 408, 902

[56] References Cited

U.S. PATENT DOCUMENTS 4,510,198 4/1985 Rheaume ..... 428/246

4,854,352 8/1989 Combier ..... 428/226

*Primary Examiner*—James J. Bell

*Attorney, Agent, or Firm*—Cort Flint

[57] ABSTRACT

A conform fabric comprised of a multi-ply fabric having an upper ply and a lower ply each woven of warp and weft yarns, with the plies secured together by weaving selected warp yarns of one of the plies with selected weft yarns of the other of the plies. Both the upper and lower plies are each woven in a crowfoot satin weave of such a density as to allow a bias stretch of at least 40%. The weave also provides that the upper ply and the lower ply present a weft face exposed side.

20 Claims, 2 Drawing Sheets

| | | | |
|---|---|---|---|
| O | O | X | O |
| O | O | O | X |
| O | X | O | O |
| O | X | X | X |

| | | | |
|---|---|---|---|
| X | X | O | X |
| X | O | X | O |
| O | X | X | X |

| | | T | | T | | T | | T | |
|---|---|---|---|---|---|---|---|---|---|
| | | 1 | 2 | 3 | 4 | 5 | 6 | 7 | 8 |
| 16 | | X | X | X | X | X | X | O | O |
| 15 | T | O | O | O | O | X | O | O | O |
| 14 | | X | O | X | X | X | X | X | X |
| 13 | T | O | O | O | O | O | O | X | O |
| 12 | | X | X | X | X | X | O | X | X |
| 11 | T | O | O | X | O | O | O | O | O |
| 10 | | X | X | X | O | X | X | X | X |
| 9 | T | X | O | O | O | O | O | O | O |
| 8 | | X | X | X | X | X | X | X | O |
| 7 | T | O | O | O | O | X | O | O | O |
| 6 | | X | O | X | X | X | X | X | X |
| 5 | T | O | O | O | O | O | O | X | O |
| 4 | | X | X | X | X | X | O | X | X |
| 3 | T | O | O | X | O | O | O | O | O |
| 2 | | X | X | X | O | X | X | X | X |
| 1 | T | X | O | O | O | O | O | O | O |

DUAL LAYER COMPOSITE FABRIC

BACKGROUND OF THE INVENTION

The invention relates to a multi-layer conform fabric which is coated with a thermo-setting resin.

Multi-layer fabrics have been known for years. U.S. Pat. No. 4,135,025 shows an arrangement where a multi-layer fabric is woven for use as garment inserts. This fabric does not discuss bias stretch or relative movement between fabric layers. U.S. Pat. Nos. 2,816,578 and 2,925,098 are directed to multi-layer ballistic fabrics. These fabrics do have relative movement between the yarns. The movement is designed to entrap and stop a projectile. These patents are not concerned with a conform fabric or with bias stretch.

U.S. Pat. Nos. 2,857,654 and 4,821,780 are directed to a multiply car top and a paper forming fabric respectively. Both patents are concerned with fabric stability.

U.S. Pat. Nos. 4,510,198 and 4,854,352 are directed to multi-layer conform fabrics. Neither patent is directed to a two layered fabric with the layers interconnected at selected spaced intervals. While these patents do discuss movement between fabric layers, there is no discussion of bias stretch. There is not disclosure of a weave structure which allows movement between the forming yarns. U.S. Pat. No. 4,854,352 does not disclose separate fabric layers. These fabrics are essentially high density, heavy fabrics which require two warp beams during weaving.

An object of this invention is to provide a conform fabric which can be produced on an eight harness loom using only one warp beam.

Another object of the invention is to provide a multi-layer conform fabric in which the layers are separate but joined at spaced intervals so that limited relative movement between the layers is allowed.

Another object of the invention is to provide a conform fabric having low yarn density in each fabric layer or ply so as to allow relative movement between the forming yarns, while maintaining fabric stability by periodic interlacing between the fabric layers.

Another object of the invention is to provide conform fabrics having areal weights at least as great as standard 8 harness satin fabrics and exhibiting increased bias stretch.

Another object of the invention is to provide a multi-layer woven conform fabric having between 30% and 45% bias stretch while the yarns forming the fabric are inelastic.

SUMMARY OF THE INVENTION

The invention consists of a multi-layer conform fabric having an upper surface and a lower surface for use with configurated molds to form resin molded fabric shapes comprising an upper fabric layer and a lower fabric layer. Respective warp and weft yarns are interwoven with each other to form of the upper fabric layer and the lower fabric layer. The upper fabric layer is woven in a weft yarn face crow-foot satin weave and the lower fabric layer is woven in a warp yarn face crow-foot satin weave so that the upper and the lower surfaces of the conform fabric are weft yarn dominated. Only certain selected warp yarns of the upper fabric layer are interwoven with certain selected weft yarns of the lower fabric layer so as to interconnect the upper and lower fabric layers. This weave structure provides that when the conform fabric is placed in a mold, some shifting between the fabric layers and between the warp and weft yarns forming the fabric layers so that the conform fabric will conform smoothly to the configuration of the mold.

It is most desirable that every fourth warp yarn of the upper layer constitute the certain selected warp yarns and that every eighth weft yarn of the lower fabric layer constitute the certain selected weft yarns. It is normal that the warp and weft yarns are formed of inelastic material. Because of the weave structure, the conform fabric still has a bias stretch of at least 30%.

A conform fabric is comprised of a multi-ply fabric having an upper ply and a lower ply each woven of warp and weft yarns, with the plies secured together by weaving selected warp yarns of one of the plies with selected weft yarns of the other of the plies. Both the upper and lower plies are each woven in a crowfoot satin weave of such a density as to allow a bias stretch of at least 30%. The weave also provides that the upper ply and the lower ply present a weft face exposed side.

At least one of the warp and weft yarns are continuous filament glass yarns, however, in most instances, both the warp and weft yarns are continuous filament glass yarns. The fabric density is preferably within a range of 40 to 70 warp and weft yarns per inch with the warp and weft yarns divided equally between the upper ply and the lower ply.

In use, the conform fabric is shaped to a desired form and impregnated with thermosetting resin, or laminated with thermoplastic. The conform fabric may also be pre-impregnated with a resin or plastic and subsequently formed by heat and/or pressure.

Alternatively, the yarns of the conform fabric may consist of a blend of the aforementioned reinforcing fibers and thermoplastic fibers. These blended yarns may consist of ply blends, commingled filaments or staple blends. When formed under heat and pressure these blended conform fabrics can result in thermoplastic matrix composite articles.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Conform fabrics are designed to have at least as many yarns in the warp and weft as typical eight or twelve harness satin fabrics which are used as composite reinforcements. Eight or twelve harness fabrics for composite reinforcement are typically constructed to have at least 55% of the theoretical maximum number of warp and filling ends for the weave and yarn employed. The maximum theoretical construction can be calculated based on the compact cover system of Dr. J. B. Dickerson which is known to those practiced in the art of fabric design. The compact cover for any yarn is the theoretical maximum number of yarns which can be laid side by side in one inch. The maximum weave construction is determined by the number of warp or weft yarns per weave pattern repeat divided by the number of yarns per repeat plus the number of weave interlacings per repeat multiplied by the compact cover of the yarns employed.

For example, in the plain weave there are two warp or weft yarns per repeat and two interlacings per repeat so the maximum construction would be:

$$\frac{2}{2+2} \text{ or } .5 \times \text{the compact cover}$$

for an eight harness satin:

$$\frac{8}{8+2} \text{ or } .8 \times \text{the compact cover}$$

for a twelve harness satin:

$$\frac{12}{12+2} \text{ or } .857 \times \text{the compact cover.}$$

Satin weave fabrics used for composite reinforcement are typically designed to have at least 55% of the theoretical maximum construction.

Figure 1:
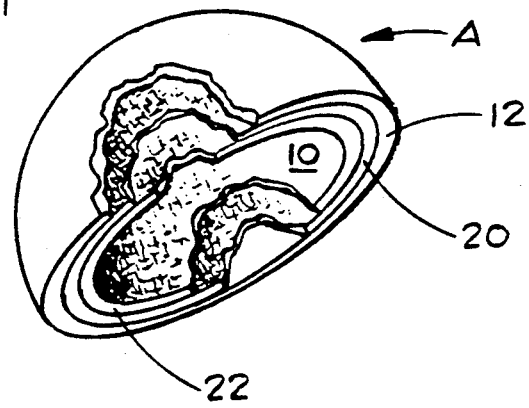
FIG. 1 is a sectional side elevational view showing a cone element consisting of a thermosetting resin and a resin coated two ply shaped fabric.

Referring now to FIG. 1, a cone shaped reinforced article A is shown consisting of two layered conform fabric 10 shaped to the desired form and coated with a thermosetting resin 12. The conform fabric acts to reinforce article A. In order for fabric to conform smoothly to the shape shown in FIG. 1, without wrinkles and/or folds, the fabric must posses the capability of bias stretch and relative movement between the fabric layers. The fabric of the invention has a bias stretch capability of 30% and 45%. A bias stretch capability of 38% has been determined to be preferred.

Figure 2:
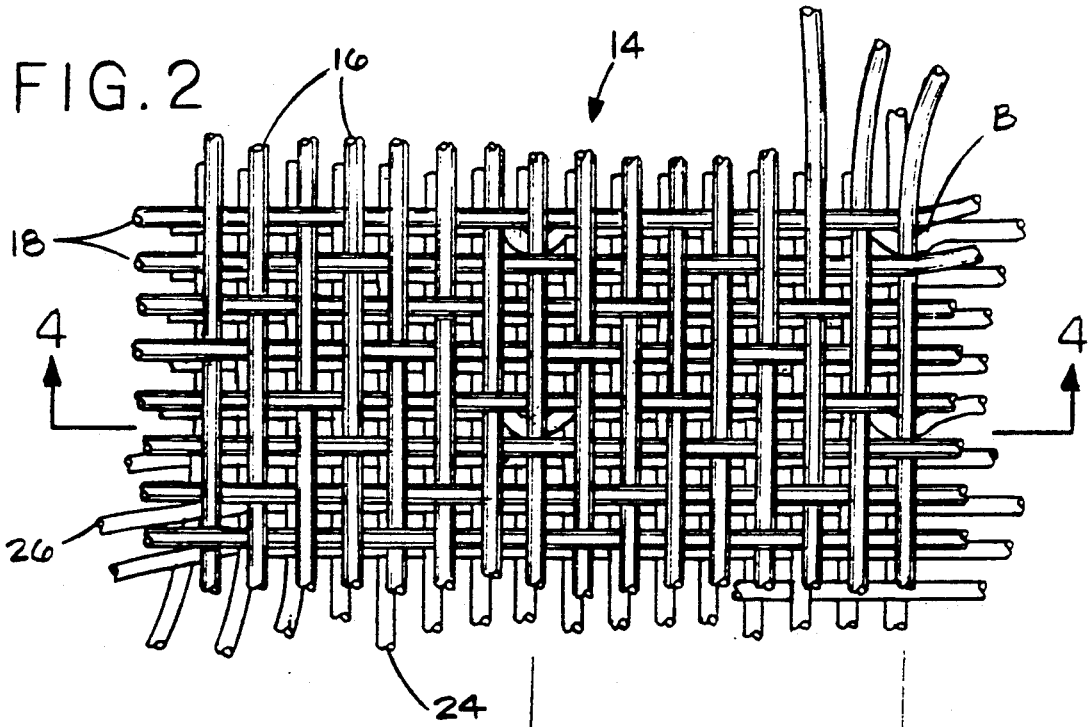
FIG. 2 is a partial plan view of the upper surface of the upper ply of a two ply fabric with the yarns of the lower ply shown in shadow.
Figure 4:
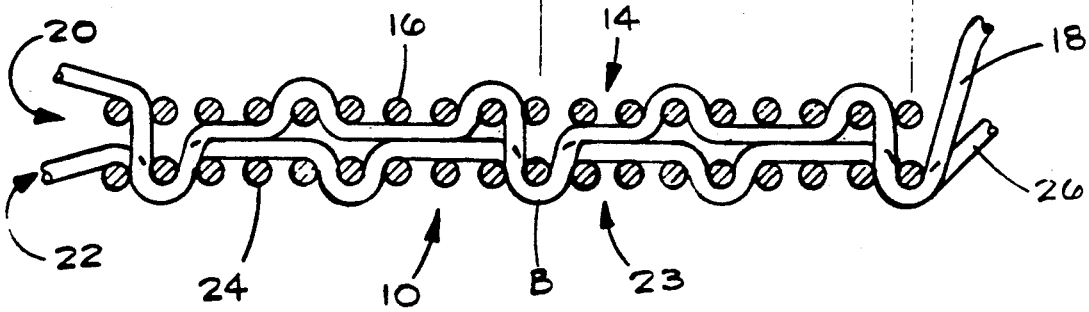
FIG. 4 is a side view of FIG. 2 taken along line 4—4.
Figures 3, 5, 6, 7:
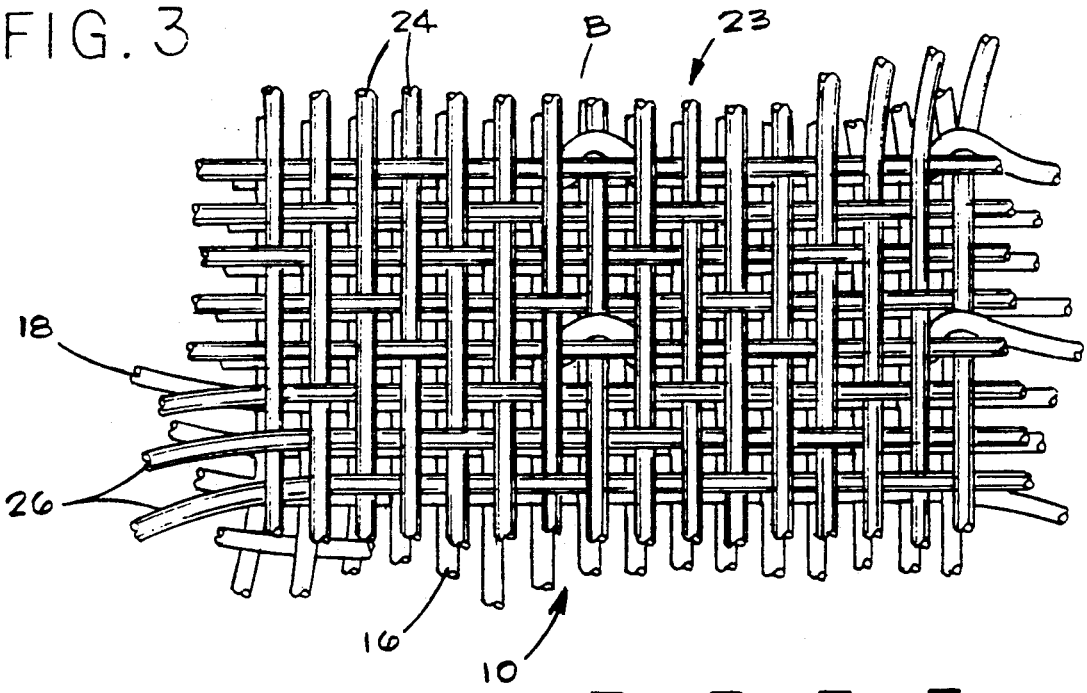
FIG. 3 is a partial plan view of the lower ply of a two ply fabric with the yarns of the upper ply shown in shadow.
FIGS. 5 and 6 show weave diagrams for the upper and lower ply respectively.
FIG. 7 is the weave draft.

The conform fabric 10 of the invention preferably consists of two plies woven in a crow-foot satin weave. As shown in FIGS. 2, 3, and 4, conform fabric 10 has an upper face surface 14 which is a weft or filling face. That is weft yarns 16 appear or float over three warp yarns 18 before passing beneath one of the warp yarn 18 for every pick. This weave is true only for upper surface 14 of upper ply 20 of conform fabric 10. Lower surface 23 of lower ply 22 of conform fabric 10 is also woven to present a weft or filling face as shown in FIGS. 3 and 4. This requires that weft yarns 24 pass under three warp yarns 26 of lower ply 22 before passing over a warp yarn. The upper face of lower ply 22 and lower face of upper ply 20 are adjacent each other and are in the interior of the fabric. These faces are warp dominated.

The resulting fabric is a multi-layer fabric having upper and lower faces 14,23 each having a predominance of weft yarns 16,24 exposed. To bring about this warp/weft relationship, upper layer 20 is woven as a weft face crow-foot satin weave while lower layer 22 is woven in a warp face crow-foot satin weave. The basic weave diagram for the upper layer is shown in FIG. 5. The "x" represents a warp yarn passing over a weft yarn while the "o" represents a weft yarn passing over a warp yarn. The basic weave diagram for the lower fabric layer is shown in FIG. 6.

The upper layer 20 is secured to lower layer 22 by interweaving each eighth warp of the weave which is the fourth warp yarn of upper layer 20 with every sixteenth pick or insertion of weft, which insertion occurs in the lower layer as shown at B in FIGS. 2, 3, and 4. By so spacing the interconnecting points B, a degree of relative movement between the layers is allowed. By weaving with a crow-foot satin weave pattern, a degree of movement between warps 18,26 and weft yarns 16,24 is allowed. These combined movements allow the fabric to achieve a bias stretch under tension of between 30% and 45% and to retain a bias stretch of between 23% and 38% after tension is released.

The preferred yarn used to form conform fabric 10 is multifilament glass. The particular yarn size is totally dependent upon the intended use of the fabric and does not form a part of this invention. Glass yarn sizes ECDE 75 1/0, SZCG 75 1/0, SZCG 150 1/0, and ECG 37 1/0 have been used with success. The preferred yarn count is between 40 and 70 warp and weft yarns per inch with half being in each fabric layer. It has been found that 58 warp yarns per inch and 56 picks per inch produce a most satisfactory conform fabric. This would result in 29 warp yarns and 29 weft yarns per inch in each fabric layer.

A crow-foot satin weave is a standard weave structure. The instant fabric is woven using eight harnesses as illustrated in the weave draft shown in FIG. 7. The odd numbered harnesses 1, 3, 5, and 7 weave the top fabric layer as indicated at T and the even numbered harnesses 2, 4, 6, and 8 weave the lower layer. The odd numbered warp yarns, which correspond to the odd numbered harnesses 1, 3, 5, and 7 weave upper fabric layer 14 and the even numbered warp yarns, which also correspond with the even numbered harnesses 2, 4, 6, and 8 weave the lower fabric layer 23. A repeat of the weave pattern consists of sixteen picks or weft insertions and eight warp yarns. As can be seen in FIG. 7, warp yarns 1–6 and 8 weave identically with a first group of weft insertions 1–8 and a second group of weft insertions 9–16. Warp yarn 7, however, weaves differently with weft insertions 8 and 16. It is at weft 16 that the lower ply is connected with the upper ply. The pattern shown repeats both length-wise and width-wise throughout the fabric.

It will be understood by these practiced in the art of fabric design that the optimum number of yarns per inch is highly dependent on the size of the yarns employed. Thus, the use of heavier yarns may require fewer yarns per inch or the use of lighter yarns may require more yarns per inch than the aforementioned range. The warp and weft yarns may also be formed of glass fiber, aramid fiber, carbon or graphite fiber, silicon carbide fiber, high modulus polyethylene fiber or other high strength high modulus fibers which may be employed as reinforcements in composite structures.

EXAMPLE 1

The current state of art is illustrated by an 8 harness satin fiberglass fabric woven from fiberglass ECDE 75 1/10 yarns and meeting Military Specification 9084C Type VIII B. The bias stretch of this fabric under tension is 20%. When tension was relaxed the bias stretch retained was 15%. The construction of this fabric is 63.7% of the theoretical maximum construction for an eight harness satin fabric.

EXAMPLE 2

A conform fabric was woven from the same ECDE 75 1/10 fiberglass yarns using the weave illustrated in FIGS. 2, 3, 4, and 7 of this specification.

The number of ends and picks were chosen to produce fabric with an areal weight at least as heavy as the fabric of Example 1. The resulting conform fabric had a bias stretch under tension of 42%. When tension was relaxed the bias stretch retained was 35%.

TABLE 1

| Example No. | Warp Yarns Per Inch | Weft Yarns Per Inch | Weight Ox./Sq. Yd. | % Bias Stretch Under Tension | % Bias Stretch Remaining After Tension Release |
|---|---|---|---|---|---|
| 1 | 58 | 53 | 8.8 | 20% | 15% |
| 2 | 58 | 57 | 9.1 | 42% | 35% |

While a preferred embodiment of the invention has been described using specific terms, such description is for illustrative purposes only, and it is to be understood that changes and variations may be made without departing from the spirit or scope of the following claims.

What is claimed is:

1. A multi-layer conform fabric having an upper surface and a lower surface for use with configurated molds to form resin molded fabric shapes, said conform fabric comprising:

an upper fabric layer and a lower fabric layer;

respective warp and weft yarns interwoven with each other to form each of said upper fabric layer and said lower fabric layer;

said upper fabric layer is woven in a weft yarn face crow-foot satin weave;

said lower fabric layer is woven in a warp yarn face crow-foot satin weave so that said upper and said lower surfaces of said conform fabric are weft yarn dominated; and certain selected warp yarns of said upper fabric layer interweave with certain selected weft yarns of said lower fabric layer so as to interconnect said upper and lower fabric layers whereby when said conform fabric is placed in said mold shifting between said fabric layers and between said warp and weft yarns forming said fabric layers allows said conform fabric to conform smoothly to said mold configuration.

2. The conform fabric of claim 1 wherein every fourth warp yarn of said upper layer constitutes said certain selected warp yarns.

3. The conform fabric of claim 1 wherein every eighth weft yarn of said lower fabric layer constitutes said certain selected weft yarns.

4. The conform fabric of claim 1 wherein said warp and weft yarns are formed of inelastic material and said conform fabric has a bias stretch of at least 30%.

5. The conform fabric of claim 4 wherein said conform fabric has at least a 23% bias stretch remaining after release of said tension.

6. A conform fabric comprising a multi-layered fabric consisting of at least an upper layer woven in a selected weave pattern of warp and weft yarns and a lower layer woven in a selected weave pattern of warp and weft yarns;

said upper layer and said lower layer each having an upper face and a lower face;

said weave pattern of said upper layer and said weave pattern of said lower layer providing that said upper face of said upper layer and said lower face of said lower layer are woven with a predominance of said weft yarns exposed on each face; and selected of said upper layer warp and weft yarns weaving with selected of said lower layer warp and weft yarns at spaced intervals to secure said layers together to form said multi-layered fabric.

7. Conform fabric of claim 6 wherein said upper layer and said lower layer are secured together by weaving selected warp of said upper layer with selected weft of said lower layer.

8. Conform fabric of claim 6 wherein said upper and lower layers are woven in a crowfoot satin weave pattern.

9. Conform fabric of claim 6 wherein said spaced intervals comprise sixteen weft yarns.

10. Conform fabric of claim 6 wherein said warp and weft yarns are continuous filament glass yarns.

11. Conform fabric comprising a multi-ply fabric having an upper ply and a lower ply each woven of warp and weft yarns;

said plies are secured together by weaving selected warp yarns of one of said plies with selected weft yarns of the other of said plies;

said upper ply and said lower ply each presenting weft face exposed side;

said upper and lower plies are each woven in a crowfoot satin weave of such a density as to allow a bias stretch of at least 30%.

12. Conform fabric of claim 11 wherein at least one of said warp and weft yarns are continuous filament glass yarns.

13. Conform fabric of claim 11 wherein both said warp and weft yarns are continuous filament glass yarns.

14. Conform fabric of claim 10 wherein said density is within a range of 40 to 70 warp and weft per inch.

15. Conform fabric of claim 13 wherein said warp and weft yarns are divided equally between said upper ply and said lower ply.

16. Conform fabric of claim 11 wherein said conform fabric is resin coated prior to being shaped to a desired form.

17. Conform fabric of claim 16 wherein said conform fabric is resin cured.

18. Conform fabric of claim 11 wherein said conform fabric is shaped to a desired form and impregnated with a thermosetting resin.

19. Conform fabric of claim 18 wherein said conform fabric is resin cured.

20. Conform fabric of claim 11 wherein said warp and weft yarns are formed of at least one of glass, aramid, silicon carbide, polyethylene and graphite.

* * * * *